US008073688B2

(12) United States Patent
Yoshioka et al.

(10) Patent No.: US 8,073,688 B2
(45) Date of Patent: Dec. 6, 2011

(54) VOICE PROCESSING APPARATUS AND PROGRAM

(75) Inventors: Yasuo Yoshioka, Hamamatsu (JP); Alex Loscos, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 1276 days.

(21) Appl. No.: 11/165,695

(22) Filed: Jun. 24, 2005

(65) Prior Publication Data

US 2006/0004569 A1 Jan. 5, 2006

(30) Foreign Application Priority Data

Jun. 30, 2004 (JP) ..... 2004-194800

(51) Int. Cl.
*G10L 19/14* (2006.01)

(52) U.S. Cl. ..... 704/225; 704/228; 704/258

(58) Field of Classification Search ..... 704/228, 704/258

See application file for complete search history.

(56) References Cited

U.S. PATENT DOCUMENTS

| | | | | |
|---|---|---|---|---|
| 4,276,802 | A | 7/1981 | Mieda et al. | |
| 5,336,902 | A * | 8/1994 | Nigaki et al. | 257/10 |
| 6,549,884 | B1 * | 4/2003 | Laroche et al. | 704/207 |
| 2003/0009336 | A1 * | 1/2003 | Kenmochi et al. | 704/258 |
| 2003/0221542 | A1 * | 12/2003 | Kenmochi et al. | 84/616 |

FOREIGN PATENT DOCUMENTS

| | | | |
|---|---|---|---|
| EP | 1 220 195 | A2 | 7/2002 |
| EP | 1 220 195 | A3 | 7/2002 |
| JP | 54-131921 | A | 10/1979 |
| JP | 2000-003200 | | 1/2000 |
| JP | 2003-288095 | | 10/2003 |

OTHER PUBLICATIONS

Yingyong Qi, "Replacing Tracheoesophageal Voicing Sources Using LPC Synthesis", The Journal of the Acoustical Society of America, American Institute of Physics, New York, US, vol. 88, No. 3, Sep. 1, 1990, pp. 1228-1235.

Notice of Grounds for Rejection mailed Mar. 23, 2010, for JP Patent Application No. 2004-194800, with English Translation, six pages.

* cited by examiner

*Primary Examiner* — Leonard Saint Cyr
(74) *Attorney, Agent, or Firm* — Morrison & Foerster LLP

(57) ABSTRACT

Envelope identification section generates input envelope data (DEVin) indicative of a spectral envelope (EVin) of an input voice. Template acquisition section reads out, from a storage section, converting spectrum data (DSPt) indicative of a frequency spectrum (SPt) of a converting voice. On the basis of the input envelope data (DEVin) and the converting spectrum data (DSPt), a data generation section specifies a frequency spectrum (SPnew) corresponding in shape to the frequency spectrum (SPt) of the converting voice and having a substantially same spectral envelope as the spectral envelope (EVin) of the input voice, and the data generation section generates new spectrum data (DSPnew) indicative of the frequency spectrum (SPnew). Reverse FFT section and output processing section generates an output voice signal (Snew) on the basis of the new spectrum data (DSPnew).

11 Claims, 10 Drawing Sheets

D3 VOICE PROCESSING APPARATUS

VOICE PROCESSING APPARATUS AND PROGRAM

BACKGROUND OF THE INVENTION

The present invention relates to techniques for varying characteristics of voices.

Heretofore, various techniques have been proposed for converting a voice input by a user (hereinafter referred to as "input voice") to a voice of different characteristics from the input voice (hereinafter referred to as "output voice"). Japanese Patent Application Laid-open Publication No. 2000-3200, for example, discloses a technique for generating an output voice by adding so-called "breathiness" to an input voice. According to the disclosed technique, an output voice is generating by adding, to an input voice, components of a particular frequency band (corresponding to a third formant of the input voice) of a white noise having uniform spectral intensity over a wide frequency band width.

However, because characteristics of a voice based on an aspirate of a human (hereinafter referred to as "aspirate sound") are fundamentally different from those of a white noise, it is difficult to generate an auditorily-natural output voice by jut adding a white noise, as a component of an aspirate sound, to an input voice. Similar problem could arise in generation of other voices of various other characteristics than the output voice having breathiness added thereto, such as a voice generated by irregular vibration of the vocal band (hereinafter referred to as "hoarse voice") and a whispering voice with no vibration of the vocal band. It is generally possible to generate a hoarse voice, by using the known SMS (Spectral Modeling Synthesis) technique to extract harmonic components and non-harmonic components (also called a residual components or noise components) from an input voice, then relatively increasing the intensity of the non-harmonic components and then adding the intensity-increased non-harmonic components to the harmonic components. However, because a hoarse voice of a person involves irregular vibration of the vocal band and is fundamentally different from a voice merely rich in noise components, there would be encountered significant limitations in generating a natural hoarse voice using the conventionally-known technique.

SUMMARY OF THE INVENTION

In view of the foregoing, it is an object of the present invention to provide a technique for generating a natural output voice from an input voice.

In order to accomplish the above-mentioned object, the present invention provides an improved voice processing apparatus, which comprises: a frequency analysis section that identifies a frequency spectrum of an input voice; an envelope identification section that generates input envelope data indicative of a spectral envelope of the frequency spectrum identified by the frequency analysis section; an acquisition section that acquires converting spectrum data indicative of a frequency spectrum of a converting voice; a data generation section that, on the basis of the input envelope data generated by the envelope identification section and the converting spectrum data generated by the acquisition section, generates new spectrum data indicative of a frequency spectrum corresponding in shape to the frequency spectrum of the converting voice and having a substantially same spectral envelope as the spectral envelope of the input voice; and a signal generation section that generates a voice signal on the basis of the new spectrum data generated by the data generation section.

The voice processing apparatus arranged in the above-identified manner specifies a frequency spectrum which corresponds in shape to the frequency spectrum of the converting voice and having substantially the same spectral envelope as the spectral envelope of the input voice, so that it can provide a natural output voice reflecting therein sound quality of the converting voice while maintaining the pitch and sound color (phonological characteristics) of the input voice. The spectral envelope of the frequency spectrum indicated by the new spectrum data does not have to be exactly the same as the spectral envelope of the input voice, and it only has to have a shape generally corresponding to the spectral envelope of the input voice. More specifically, it is preferable that the spectral envelope of the frequency spectrum indicated by the new spectrum data correspond to (generally agree with) the spectral envelope of the input voice to such an extent that the pitch of the output voice auditorily equals the pitch of the input voice.

According to a first aspect of the present invention, there is provided a voice processing apparatus, wherein the acquisition section acquires, for each spectral distribution region that contains frequencies presenting respective intensity peaks in the frequency spectrum of the converting voice, converting spectrum data indicative of a frequency spectrum belonging to the spectral distribution region. Here, the data generation section includes: a spectrum conversion section that, for each spectral distribution region that contains frequencies presenting respective intensity peaks in the frequency spectrum of the input voice, generates new spectrum data on the basis of the converting spectrum data corresponding to the spectral distribution region; and an envelope adjustment section that adjusts intensity of a frequency spectrum indicated by the new spectrum data on the basis of the input envelope data. Because, in the present invention, the converting voice is divided into spectral distribution regions and then the new spectrum data is generated for each of the spectral distribution regions, the present invention is particularly suited for use in cases where local peaks appear in the frequency spectra of the converting voice and input voice. Specific example of this aspect will be later described in detail as a first embodiment of the present invention.

In the voice processing apparatus according to the first aspect of the invention, the frequency analysis section generates, for each of the spectral distribution regions that contains frequencies presenting respective intensity peaks in the frequency spectrum of the input, input spectrum data indicative of a frequency spectrum belonging to the spectral distribution region, and the spectrum conversion section generates the new spectrum data by replacing the input spectrum data of each of the spectral distribution regions with the converting spectrum data corresponding to the spectral distribution region. Because the new spectrum data can be generated by replacing the input spectrum data with the converting spectrum data for each of the spectral distribution regions, an output voice can be provided with no complicated arithmetic processing.

In the voice processing apparatus according to the first aspect of the invention, the frequency analysis section generates, for each of the spectral distribution regions that contains frequencies presenting respective intensity peaks in the frequency spectrum of the input voice, input spectrum data indicative of a frequency spectrum belonging to the spectral distribution region. Here, the spectrum conversion section adds together, for each of the spectral distribution regions of the input voice and at a particular ratio, intensity indicated by the input spectrum data of the spectral distribution region and intensity indicated by the converting spectrum data corresponding to the spectral distribution region, to thereby generate the new spectrum data indicative of a frequency spectrum having as intensity thereof a sum of the intensity. Such arrangements can provide a natural output voice reflecting therein not only the frequency spectrum of the converting voice but also the frequency spectrum of the input voice.

The voice processing apparatus of the present invention, where the frequency spectrum of the input voice and the frequency spectrum of the converting voice are added at a particular ratio, may further comprise: a sound volume detection section that detects a sound volume of the input voice; and a parameter adjustment section that varies the particular ratio in accordance with the sound volume detected by the sound volume detection section. Because the ratio between the intensity of the frequency spectrum of the input voice and the intensity of the frequency spectrum of the converting voice is varied, by the parameter adjustment section, in accordance with the input voice, the present invention can generate a more natural output voice closer to an actual human voice. If a hoarse voice is set as a converting voice to be used in the voice processing apparatus of the present invention, each input voice can be converted into a hoarse voice. The "hoarse voice" is a voice involving irregular vibration when uttered, which also involves irregular peaks and dips in frequency bands between local peaks in frequency spectra that correspond to fundamental and harmonic sounds. The irregularity (i.e., irregularity in the vibration of the vocal band) specific to such a hoarse voice tends to become prominent as the voice becomes greater in volume. Thus, in a preferred embodiment of the present invention, the parameter adjustment section varies the particular ratio in such a manner that a proportion of the intensity of the converting spectrum data increases as the sound volume detected by the sound volume detection section increases. With such arrangements, the present invention can increase the irregularity (so to speak, "hoarseness") of the output voice as the sound volume of the input voice increases, which permits voice processing precisely corresponding to actual voice utterance by a person. Further, there may be provided a designation section for designating a mode of variation in the particular ratio responsive to variation in the volume of the input voice. In this case, the present invention can generate a variety of output voices suiting a user's taste. It should be appreciated that, whereas the converting voice has been set forth above as a hoarse voice, the converting voice to be used in the inventive voice processing apparatus may be of any other characteristics than those of a hoarse voice.

According to a second aspect of the present invention, the voice processing apparatus further comprises: a storage section that stores converting spectrum data for each of a plurality of frames obtained by dividing a converting voice on a time axis; and an average envelope acquisition section that acquires average envelope data indicative of an average envelope obtained by averaging intensity of spectral envelopes in the frames of the converting voice. The data generation section includes: a difference calculation section that calculates a difference between intensity of the spectral envelope indicated by the input envelope data and intensity of the average envelope indicated by the average envelope data; and an addition section that adds intensity of the frequency spectrum indicated by the converting spectrum data for each of the frames and the difference calculated by the difference calculation section, the data generation section generating the new spectrum data on the basis of a result of the addition by the addition section. In this case, the difference between the intensity of the spectral envelope indicated by the input envelope data and the intensity of the average envelope indicated by the average envelope data is converted into the frequency spectrum of the converting voice, to thereby generate the new spectrum data. Thus, the present invention can provide a natural output voice precisely reflecting therein variation over time of the frequency spectrum of the converting voice. Further, in this case, there is no need to divide the converting voice into spectral distribution regions, the present invention is suited for use in cases where no local peak appears in the frequency spectrum of the converting voice (e.g., where the converting voice is an unvoiced sound, such as an aspirate sound). Specific example of this aspect will be later described in detail as a second embodiment of the present invention.

Generally, breathiness in human voices becomes prominent particularly when the voice frequency is relatively high. Therefore, the voice processing apparatus may further comprise a filter section that selectively passes therethrough a component of a voice, indicated by the new spectrum data, that belongs to a frequency band exceeding a cutoff frequency. Further, the voice processing apparatus may further comprise a sound volume detection section that detects a sound volume of the input voice, in which case the filter varies the cutoff frequency in accordance with the sound volume detected by the sound volume detection section. Thus, it is possible to generate a more natural output voice closer to an actual voice. For example, there may be employed arrangements for raising or lowering the cutoff frequency as the volume of the input voice increases.

If an unvoiced sound, such as an aspirate sound (whispering voice) is used as the converting voice, the frequency spectrum having as its intensity the sum calculated by the addition section will correspond to the unvoiced sound. Although the unvoiced sound may be output directly as the output voice, arrangements may be made for outputting the unvoiced sound after being mixed with the input voice. Namely, for this purpose, the data generation section adds together, at a particular ratio, intensity of the frequency spectrum having as intensity thereof a value calculated by the addition section and intensity of the frequency spectrum detected by the frequency analysis section, to thereby generate the new spectrum data indicative of the frequency spectrum having as intensity thereof the sum of the intensity calculated by the data generation section. In this way, the voice processing apparatus of the present invention can provide a natural output voice by imparting breathiness to the input voice. Generally, there is a tendency that degree of breathiness in a voice, auditorily perceivable by a person, changes in accordance with the volume of the voice. In order to reproduce such a tendency, the voice processing apparatus of the present invention further comprises: a sound volume detection section that detects a sound volume of the input voice; and a parameter adjustment section that varies the particular ratio in accordance with the sound volume detected by the sound volume detection section. Because it may be deemed that breathiness in a voice, auditorily perceivable by a person, becomes more prominent as the volume of the voice decreases. Thus, in a more preferable embodiment, the parameter adjustment section varies the particular ratio in such a manner that the proportion of the intensity of the frequency spectrum, having as its intensity the value calculated by the addition section, increases as the sound volume detected by the sound volume detection section decreases. Such arrangements can provide a natural output voice matching the characteristics of the human auditory sense. Further, there may be provided a designation section for designating a mode of variation in the particular ratio in response to operation by the user, so that the present invention can generate a variety of output voices suiting the user's taste. It should be appreciated that, whereas the converting voice has been set forth above as a hoarse voice, the converting voice to be used in the inventive voice processing apparatus may be of any other characteristics than those of a hoarse voice.

Although the voice processing apparatus of the present invention may be arranged to generate an output voice on the basis of converting spectrum data corresponding to a converting voice uttered with a single pitch, other arrangements may be made for preparing in advance a plurality of converting spectrum data corresponding to a plurality of different pitches. Namely, in this case, the voice processing apparatus of the present invention may further comprise: a storage section that stores a plurality of converting spectrum data indicative of frequency spectra of converting voices different in pitch; and a pitch detection section that detects a pitch of the input voice. Here, the acquisition section acquires, from among the plurality of converting spectrum data stored in the storage section, particular converting spectrum data corresponding to the pitch detected by the pitch detection section. With such arrangements, the present invention can provide a particularly-natural output voice on the basis of converting spectrum data corresponding to the pitch of the input voice.

The voice processing apparatus of the present invention may be implemented not only by hardware, such as a DSP (Digital Signal Processor) dedicated to the voice processing, but also a combination of a computer (e.g., personal computer) and a program. The program of the present invention is arranged to cause a computer to perform: a frequency analysis process for identifying a frequency spectrum of an input voice; an envelope identification process for generating input envelope data indicative of a spectral envelope of the frequency spectrum identified by the frequency analysis process; an acquisition process for acquiring converting spectrum data indicative of a frequency spectrum of a converting voice; a data generation process for, on the basis of the input envelope data generated by the envelope identification process and the converting spectrum data acquired by the acquisition process, generating new spectrum data indicative of a frequency spectrum corresponding in shape to the frequency spectrum of the converting voice and having a substantially same spectral envelope as the spectral envelope of the input voice; and a signal generation process for generating a voice signal on the basis of the new spectrum data generated by the data generation process. The program of the present invention can achieve behavior and benefits similar to those discussed above in relation to the voice processing apparatus of the invention. The program of the present invention may be supplied to a user in a transportable storage medium, such as a CD-ROM, or may be supplied from a server apparatus via a communication network to be installed in a computer.

In the program for implementing the voice processing apparatus of the first aspect of the invention, the acquisition process acquires, for each spectral distribution region that contains frequencies presenting respective intensity peaks in the frequency spectrum of the converting voice, the converting spectrum data indicative of a frequency spectrum belonging to the spectral distribution region. The data generation process includes: a spectrum conversion process for, for each spectral distribution region that contains frequencies presenting respective intensity peaks in the frequency spectrum of the input voice, generating new spectrum data on the basis of the converting spectrum data corresponding to the spectral distribution region; and an envelope adjustment process for adjusting intensity of a frequency spectrum indicated by the new spectrum data on the basis of the input envelope data.

Further, a program for implementing the voice processing apparatus of the second aspect of the invention causes the computer to further perform an average envelope acquisition process for acquiring average envelope data indicative of an average envelope obtained by averaging spectral envelopes of a plurality of frames of a converting voice, the frames being obtained by dividing the converting voice on a time axis. Here, the data generation process includes: a difference calculation operation for calculating a difference between intensity of the spectral envelope indicated by the input envelope data and intensity of the average envelope indicated by the average envelope data; and an addition operation for adding together intensity of the frequency spectrum indicated by the converting spectrum data for each of the frames and the difference calculated by the difference calculation operation, the data generation process generating the new spectrum data on the basis of a result of addition by the addition process.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

A. First Embodiment

First of all, a description will be given about a construction and operation of a voice processing apparatus according to a first embodiment of the present invention, with reference to FIG. 1. Various components of the voice processing apparatus D1 shown in FIG. 1 may be implemented either by an arithmetic processing device, such as a CPU (Central Processing Unit), executing a predetermined program, or hardware, such as a DSP, dedicated to the voice processing; the same may apply to other embodiments to be later described.

Figure 1:
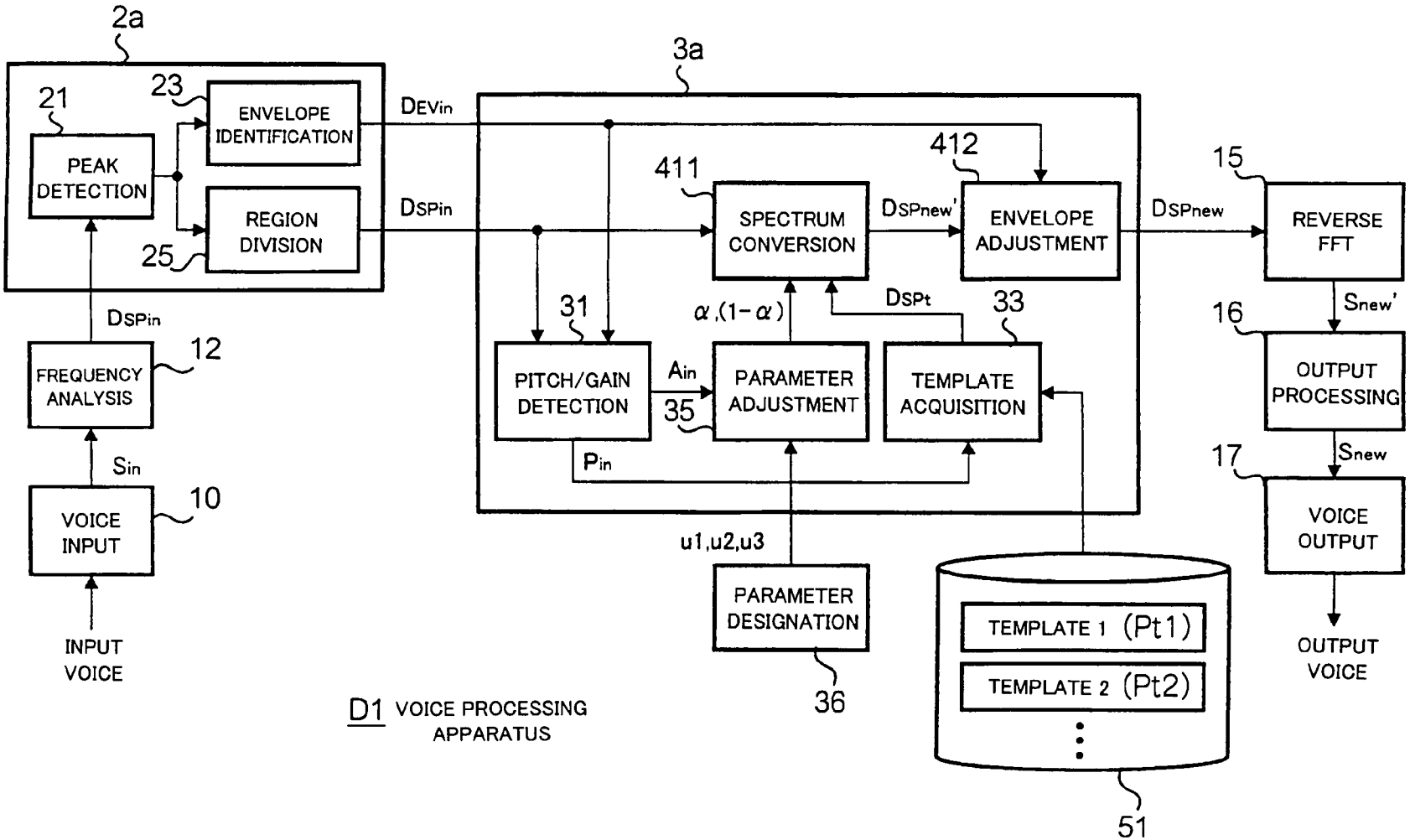
FIG. 1 is a block diagram showing a general setup of a voice processing apparatus in accordance with a first embodiment of the present invention.
Figure 2:
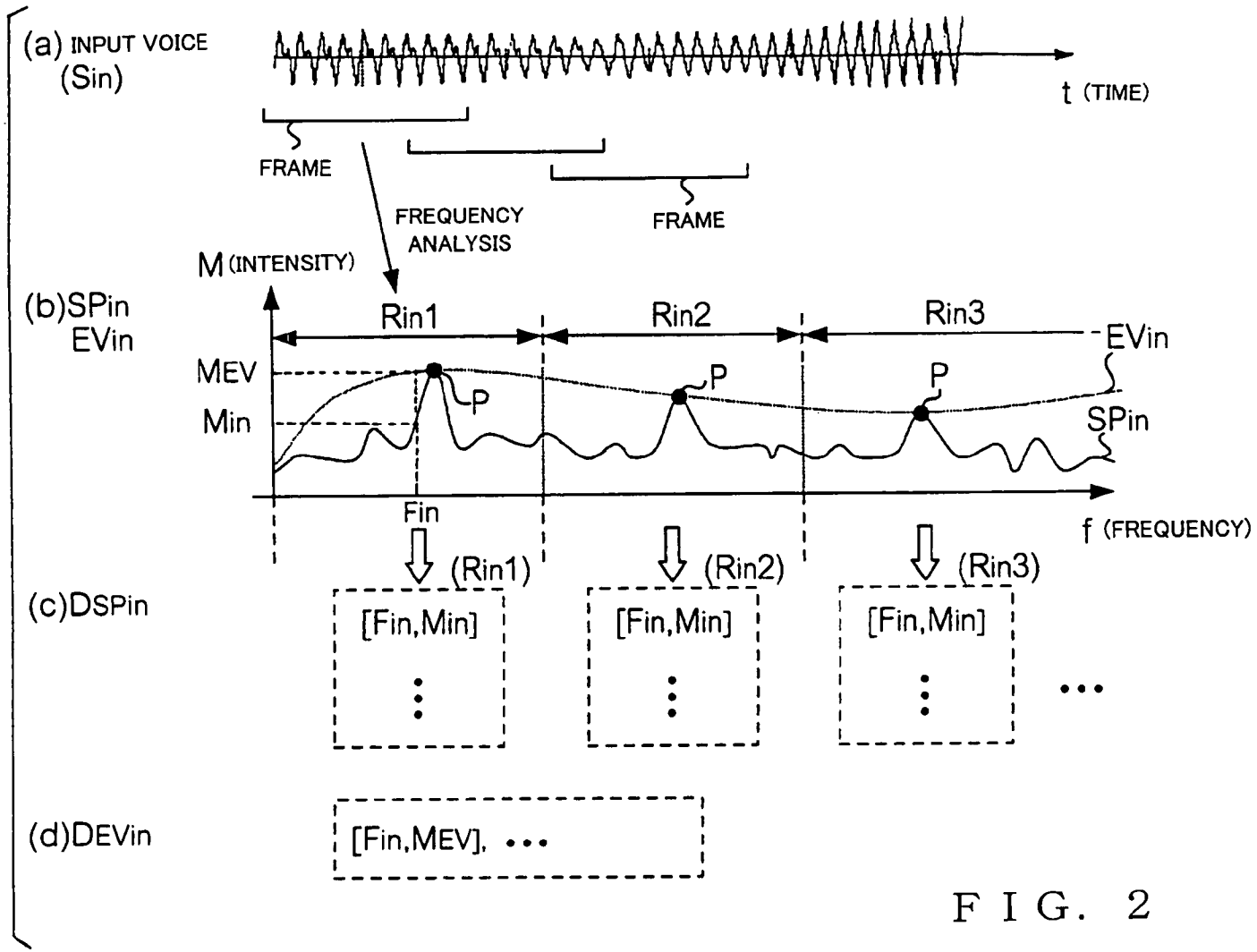
FIG. 2 is a diagram explanatory of operations for generating input spectrum data from an input voice.

Voice input section 10 shown in FIG. 1 is a means for outputting a digital electrical signal (hereinafter referred to as "input voice signal") Sin corresponding to an input voice uttered by a user. The voice input section 10 includes, for example, a microphone for outputting an analog electrical signal indicative of a waveform of an input voice, and an A/D converter for converting the analog electrical signal into a digital input voice signal Sin. Frequency analysis section 12 clips out the input voice signal Sin, supplied from the voice input section 10, per frame of a predetermined time length (e.g., ranging from 5 ms to 10 ms), and then performs frequency analysis operations, including the FFT (Fast Fourier Transform), on each frame of the input voice signal Sin to thereby detect a frequency spectrum (amplitude spectrum) of the frame of the signal SPin. As seen in section (a) of FIG. 2, the frames of the input voice signal Sin are set such that they overlap with each other on a time axis. Although these frames are simply set to have the same time length in the illustrated example, they may be varied in time length in accordance with a pitch of the input voice signal Sin. Section (b) of FIG. 2 illustrates an example of a frequency spectrum SPin identified for one of the frames. In the frequency spectrum SPin of one of the frames of the input voice signal Sin, as seen in section (b) of FIG. 2, there appear local spectral intensity peaks (hereinafter referred to simply as "local peaks") P in various frequencies corresponding to a fundamental sound and harmonic sounds. The frequency analysis section 12 outputs data indicative of the frequency spectrum SPin of each of the individual frames of the input voice signal Sin (hereinafter referred to as "input spectrum data DSPin"). The input spectrum data DSPin include a plurality of unit data. Each of the unit data comprises sets (Fin, Min) of a plurality of frequencies (hereinafter referred to as "subject frequencies") Fin set at predetermined intervals on a frequency axis and spectral intensity Min in the subject frequencies Fin. (see section (c) of FIG. 2).

As shown in FIG. 1, the input spectrum data DSPin output from the frequency analysis section 12 are supplied to a spectrum processing section 2*a*. The spectrum processing section 2*a* includes a peak detection section 21, an envelope identification section 23, and a region division section 25. The peak detection section 21 is a means for detecting a plurality of local peaks P in the frequency spectrum SPin (i.e., frequency spectrum of each of the frames of the input voice signal Sin). For this purpose, there may be employed a scheme that, for example, detects, as the local peak P, a particular peak of the greatest spectral intensity among a predetermined number of peaks (including fine peaks other than the local peak P) located close to one another on the frequency axis. The envelope identification section 23 is a means for identifying a spectral envelope EVin of the frequency spectrum SPin. As seen in section (b) of FIG. 2, the spectral envelope EVin is an envelope curve connecting between the plurality of local peaks P detected by the peak detection section 21. For the identification of the spectral envelope EVin, there may be employed, for example, a scheme that identifies the spectral envelope EVin as broken lines by linearly connecting between the adjoining local peaks P on the frequency axis, a scheme that identifies the spectral envelope EVin by interpolating, through any of various interpolation techniques like the spline interpolation, between lines passing the local peaks P, or a scheme that identifies the spectral envelope EVin by calculating moving averages of the spectral intensity Min of the individual subject frequencies Fin in the frequency spectrum SPin and then connecting between the calculated values. Then, the envelope identification section 23 outputs data indicative of the thus-identified spectral envelope (hereinafter referred to as "input envelope data DEVin"). The input envelope data DEVin include a plurality of unit data, similarly to the input spectrum data DSPin. As seen in section (d) of FIG. 2, each of the unit data includes sets (Fin, MEV) of a plurality of subject frequencies Fin selected at predetermined intervals on the frequency axis and spectral envelope intensity MEV of the subject frequencies Fin.

Further, the region division section 25 of FIG. 1 is a means for dividing the frequency spectrum SPin into a plurality of frequency bands (hereinafter referred to as "spectral distribution regions") Rin on the frequency axis. More specifically, the region division section 25 identifies a plurality of spectral distribution regions Rin such that each of the distribution regions Rin includes one local peak P and frequency bands before and behind the one local peak P as seen in section (b) of FIG. 2. As shown in section (b) of FIG. 2, the region division section 25 identifies, for example, a midpoint between two local peaks P adjoining each other on the frequency axis as a boundary between spectral distribution regions Rin (Rin1, Rin2, Rin3, . . . ). However, the region division may be effected by any other desired manner than that illustrated in section (b) of FIG. 2. For example, in each frequency band between two local peaks P adjoining each other on the frequency axis, a frequency presenting the lowest spectral intensity Min (i.e., a dip in the frequency spectrum SPin) may be identified as a boundary between the spectral distribution regions Rin. Therefore, the individual spectral distribution regions Rin may have either substantially the same band width or different band widths. As illustrated in section (c) of FIG. 2, the region division section 25 outputs the input spectrum data SPin dividedly per spectral distribution region Rin.

Further, in FIG. 1, a data generation section 3*a* is a means for generating data indicative of a frequency spectrum SPnew of an output voice (hereinafter referred to as "new spectrum data") obtained by varying characteristics of the input voice. The data generation section 3*a* in the instant embodiment specifies the frequency spectrum SPnew of the output voice on the basis of a previously-prepared frequency spectrum SPt of a voice (hereinafter referred to as "converting voice") and the spectral envelope EVin of the input voice. Storage section 51 in FIG. 1 is a means for storing data indicative of the frequency spectrum SPt of the converting voice (hereinafter referred to as "converting spectrum data DSPt"). Similarly to the input spectrum data DSPin shown in section (c) of FIG. 2, the converting spectrum data DSPt includes a plurality of unit data each comprising sets (Ft, Mt) of a plurality of subject frequencies Ft selected at predetermined intervals on the frequency axis and spectral intensity Mt of the subject frequencies Ft.

Figure 3:
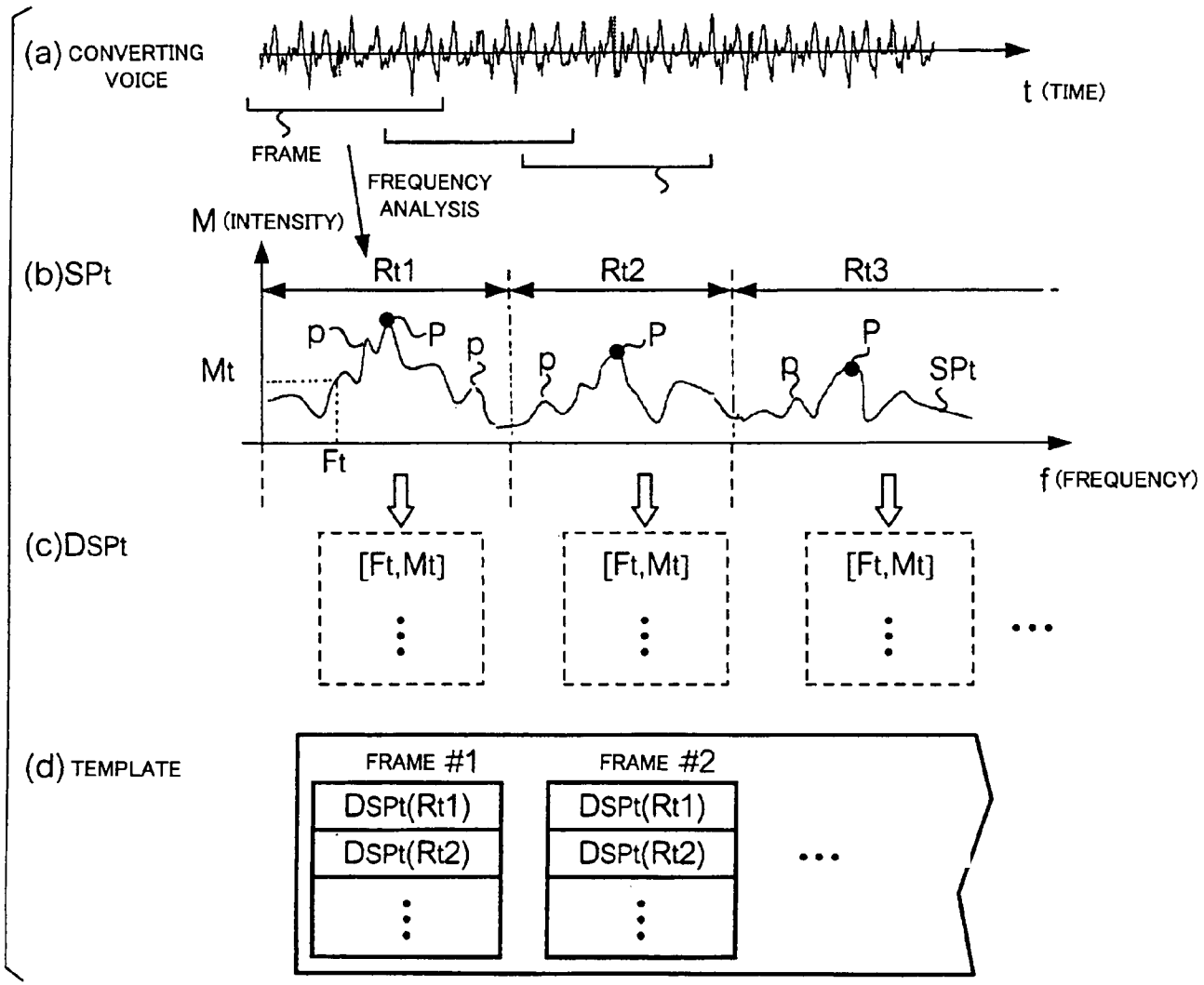
FIG. 3 is a diagram explanatory of operations for generating templates from converting voices.

Section (a) of FIG. 3 is a diagram showing a waveform of a converting voice. The converting voice is a voice uttered by a particular person for a predetermined time period while keeping a substantially-constant pitch. In section (b) of FIG. 3, there is illustrated a frequency spectrum SPt of one of the frames of the converting voice. The frequency spectrum SPt of the converting voice is a spectrum identified by diving the converting voice into a plurality of frames and performing frequency analysis (FFT in the instant embodiment) on each of the frames, in generally the same manner as set forth above for the input voice. The instant embodiment assumes that the converting voice is a voiced sound involving irregular vibration of the vocal band (i.e., hoarse voice). In the frequency spectrum SPt of the converting voice, as seen in section (b) of FIG. 3, there appear, in addition to local peaks P corresponding to a fundamental sound and harmonic sounds, peaks p corresponding to the irregular vibration of the vocal band in frequency bands between the local peaks P. As set forth above for the input voice, the frequency spectrum SPt of the converting voice is divided into a plurality of spectral distribution regions Rt (Rt1, Rt2, Rt3, . . . ).

In the storage section 51, as seen in section (c) of FIG. 3, there are stored converting spectrum data DSPt, each indicative of the frequency spectrum SPt of one of the frames as shown in section (b) of FIG. 3; the frequency spectrum SPt of the frame is divided into a plurality of spectral distribution regions Rt. Hereinbelow, a set of converting spectrum data DSPt, generated from one converting voice, will be called "template". As seen in section (d) of FIG. 3, the template includes, for each of a predetermined number of frames divided from the converting voice, converting spectrum data DSPt corresponding to the spectral distribution regions Rt in the frequency spectrum SP of the frame.

In the instant embodiment, the storage section 51 has prestored therein a plurality of templates generated on the basis of a plurality of converting voices different from each other in pitch. For example, "Template 1" shown in FIG. 1 is a template including converting spectrum data DSPt generated from a converting voice uttered by a person at a pitch Pt1, and "Template 2" is a template including converting spectrum data DSPt generated from a converting voice uttered by a person at another pitch Pt2. The storage section 51 also has prestored therein, in corresponding relation to the templates, the pitches Pt (Pt1, Pt2, . . . ) of the converting voices on which the creation of the templates was based.

Pitch/gain detection section 31 shown in FIG. 1 is a means for detecting a pitch Pin and gain (sound volume) Ain of the input voice on the basis of the input spectrum data DSPin and input envelope data DEVin. The pitch/gain detection section 31 may detect or extract the pitch Pin and gain Ain by any of various known schemes. The pitch/gain detection section 31 may detect the pitch Pin and gain Ain on the basis of the input voice signal Sin output from the voice input section 10. The pitch/gain detection section 31 informs a template acquisition section 33 of the detected pitch Pin and also informs a parameter adjustment section 35 of the detected gain Ain. The template acquisition section 33 is a means for acquiring any one of the plurality of templates stored in the storage section 51 on the basis of the pitch Pin informed by the pitch/gain detection section 31. More specifically, the template acquisition section 33 selects and reads out, from among the stored templates, a particular template corresponding to a pitch Pt approximate to (or matching) the pitch Pin of the input voice. The thus read-out template is supplied to a spectrum conversion section 411.

The spectrum conversion section 411 is a means for specifying a frequency spectrum SPnew' on the basis of the input spectrum data supplied from the region division section 25 and converting spectrum data DSPt of the template supplied from the template acquisition section 33. In the instant embodiment, the spectral intensity Min of the frequency spectrum SPin indicated by the input spectrum data DSPin and the spectral intensity Mt of the frequency spectrum SPt indicated by the converting spectrum data DSPt are added together at a particular ratio, to thereby specify the frequency spectrum SPnew', as will be detailed below with reference to FIG. 4.

Figure 4:
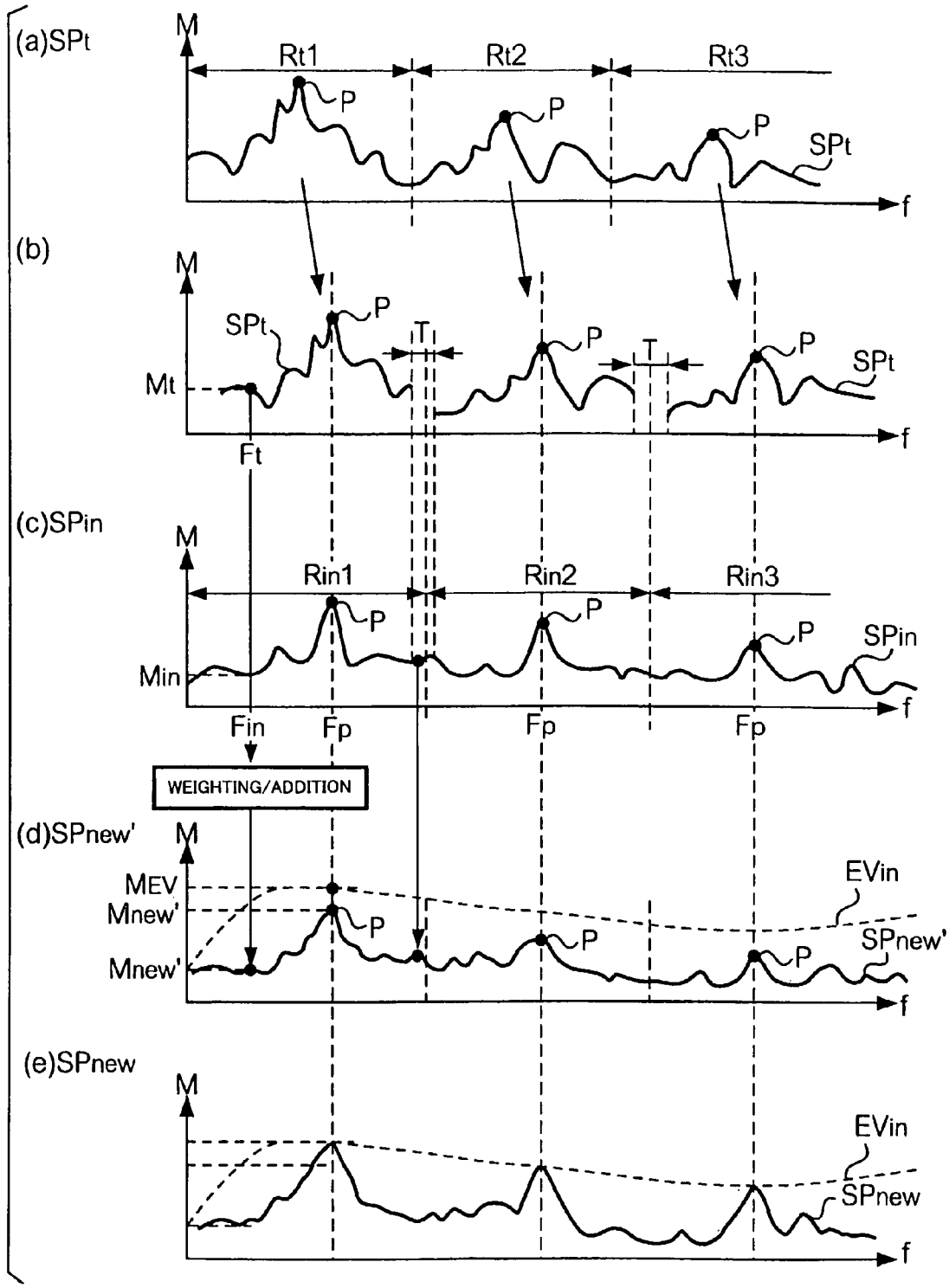
FIG. 4 is a diagram explanatory of operations performed by a data generation section in the voice processing apparatus.

As having been set forth above, the frequency spectrum SPin identified from each of the frames of the input voice is divided into a plurality of spectral distribution regions Rin (see section (c) of FIG. 4), and the frequency spectrum SPt identified from each of the frames of the converting voice is divided into a plurality of spectral distribution regions Rt (see section (a) of FIG. 4). First, the spectrum conversion section 411 associates the spectral distribution regions Rin of the frequency spectrum SPin and the spectral distribution regions Rt of the frequency spectrum SPt with each other. For example, those spectral distribution regions Rin and Rt close to each other in frequency band are associated with each other. In an alternative, the spectral distribution regions Rin and Rt arranged in predetermined order may be associated with each other after being selected in accordance with their respective positions in the predetermined order.

Second, the spectrum conversion section 411, as seen in sections (a) and (b) of FIG. 4, moves or repositions the frequency spectra SPt of the individual spectral distribution regions Rt on the frequency axis so as to correspond to the frequency spectra SPin of the individual spectral distribution regions Rin. More specifically, the spectrum conversion section 411 repositions the frequency spectra SPt of the individual spectral distribution regions Rt on the frequency axis in such a manner that the frequencies of the local peaks P belonging to the spectral distribution regions Rt substantially match that frequencies Fp of the local peaks P belonging to the spectral distribution regions Rin (section (c) of FIG. 4) associated with the spectral distribution regions Rt.

Third, the spectrum conversion section 411 adds together, at a predetermined ratio, the spectral intensity spectral intensity Min in the subject frequency Fin of the frequency spectrum SPin and the spectral intensity Mt in the subject frequency Ft of the frequency spectrum SPt (section (b) of FIG. 4) corresponding to (e.g., matching or approximate to) the subject frequency Fin. Then, the spectrum conversion section 411 sets the resultant sum of the intensity as spectral intensity Mnew' in the subject frequency of the frequency spectrum SPnew'. More specifically, the spectrum conversion section 411 specifies the frequency spectrum SPnew' per subject frequency Fin, by adding 1) a numerical value ($\alpha \cdot Mt$) obtained by multiplying the spectral intensity Mt of the frequency spectrum SPt, indicated in section (b) of FIG. 4, by a weighting value $\alpha$ ($0 \leqq \alpha \leqq 1$) and 2) a numerical value ($(1-\alpha) \cdot Min$) obtained by multiplying the spectral intensity Min of the frequency spectrum SPin by a weighting value ($1-\alpha$) and thereby setting the resultant sum as the spectral intensity Mnew' ($=\alpha \cdot Mt+(1-\alpha) \cdot Min$) for the subject frequency Fin. Then, the spectrum conversion section 411 generates new spectrum data DSPnew' indicative of the frequency spectrum SPnew'. Note that, if the band width of the spectral distribution region Rt of the converting voice is narrower than the band width of the spectral distribution region Rin of the invoice voice, there will occur a frequency band T where the frequency spectrum SPt corresponding to the subject frequency Fin of the frequency spectrum SPin does not exist. For such a frequency band T, a minimum value of the intensity Min of the frequency spectrum SPin is used as the intensity Mnew' of the frequency spectrum SPnew'; alternatively, the intensity Mnew' of the frequency spectrum SPnew' in that frequency band may be set at zero. By the foregoing operations being carried out for each of the frames, the frequency spectrum SPnew' is specified for each of the frames.

Because the number of the frames of the input voice depends on a time length of voice utterance by the user while the number of the frames of the converting voice is predetermined, the number of the frames of the input voice and the number of the frames of the converting voice often do not agree with each other. If the number of the frames of the converting voice is greater than the number of the frames of the input voice, it suffices to discard any of the converting spectrum data DSP, included in one template, which correspond to one or more extra (i.e., too many) frames. If, on the other hand, the number of the frames of the converting voice is smaller than the number of the frames of the input voice, the converting spectrum data DSP may be used in a looped (i.e., circular) fashion; for example, after use of the converting spectrum data DSPt corresponding to the last frame in one template, the converting spectrum data DSPt corresponding to the first (or leading) frame included in the template may be used again.

As described above, the instant embodiment uses a hoarse voice as the converting voice, so that the voice represented by the frequency spectrum SPnew' is a hoarse voice reflecting therein hoarse characteristics of the converting voice. Generally, there is a tendency that roughness (i.e., degree of irregularity of vibration of the vocal band), specific to such a hoarse voice, becomes more auditorily prominent (namely, the voice sounds more rough) as the volume of the voice increases. In order to reproduce such a tendency, the weighting value $\alpha$ is controlled, in the instant embodiment, in accordance with the gain Ain of the input voice.

Figure 5:
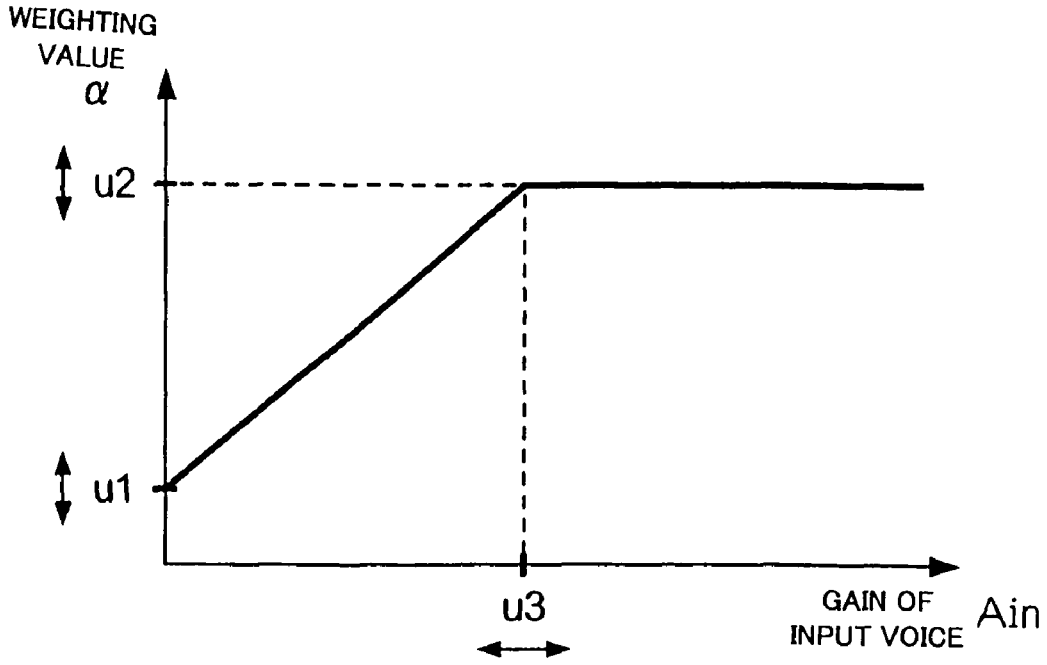
FIG. 5 is a graph plotting relationship between a gain of an input voice and a weighting value in the first embodiment.

FIG. 5 is a graph plotting relationship between the gain Ain of the input voice and the weighting value $\alpha$. As illustrated, when the gain Ain is small, the weighting value $\alpha$ is set at a relatively small value (while the weighting value $(1-\alpha)$ is set at a relatively great value. As set forth above, the intensity Mnew' of the frequency spectrum SPnew' is the sum of the product between the spectral intensity Mt of the frequency spectrum SPt and the weighting value a and the product between the spectral intensity Min of the frequency spectrum SPin and the weighting value $(1-\alpha)$. Thus, when the weighting value a is small, an influence of the frequency spectrum SPt on the frequency spectrum SPnew' is reduced relatively; therefore, in such a case, the auditory roughness of the voice represented by the frequency spectrum SPnew' decreases. As also seen in FIG. 5, the weighting value $\alpha$ increases (and the weighting value $(1-\alpha)$ decreases) as the gain Ain becomes greater. When the weighting value $\alpha$ is great, the influence of the frequency spectrum SPt on the frequency spectrum SPnew' is increased relatively, so that the auditory roughness of the voice represented by the frequency spectrum SPnew' increases. The parameter adjustment section 35 shown in FIG. 1 is a means for adjusting the weighting value $\alpha$ for the gain Ain, detected by the pitch/gain detection section 31, to follow the characteristics shown in FIG. 5 and specifying the weighting values $\alpha$ and $(1-\alpha)$ to the spectrum conversion section 411.

Further, in the instant embodiment, the relationship between the gain Ain of the input voice and the weighting value $\alpha$ can be adjusted as desired by the user. Parameter designation section 36 shown in FIG. 1 includes operators (operating members) operable by the user. The parameter designation section 36 informs the parameter adjustment section 35 of parameters u1, u2 and u3 input in response to user's operation of the operators. As seen in FIG. 5, the parameter u1 represents a value of the weighting value $\alpha$ when the gain Ain of the input voice is of a minimum value, the parameter u2 represents a maximum value of the weighting value $\alpha$, and the parameter u3 represents a value of the gain Ain when the weighting value $\alpha$ reaches the maximum value u2. Thus, if the user has increased the value of the parameter u2, it is possible to relatively increase the roughness of an output voice when the input voice has a great sound volume (i.e., when the gain Ain of the input voice is greater than the value of the parameter u3). If the user has increased the gain Ain, it is possible to increase the range of the input voice gain Ain within which the roughness of the output voice can be varied.

The new spectrum data DSPnew' of each of the spectral distribution regions, generated per frame of the input voice in the above-described manner, is supplied to an envelope adjustment section 412. The envelope adjustment section 412 is a means for specifying a frequency spectrum SPnew by adjusting the spectral envelope of the spectrum data SPnew' to assume a shape corresponding to the spectral envelope EVin of the input voice. In section (d) of FIG. 4, the spectral envelope EVin of the input voice is indicated by a dotted line, along with the frequency spectrum SPnew'. As shown, the frequency spectrum SPnew' does not necessarily correspond in shape to the spectral envelope EVin. Thus, if a voice corresponding to the frequency spectrum SPnew' is audibly produced directly as the output voice, the output voice will have a different pitch and sound color from the input voice and thereby tend to give an odd feeling to the user. So, the instant embodiment is constructed to control the pitch and sound color of the output voice to conform to those of the input voice by the envelope adjustment section 412 adjusting the spectral envelope of the frequency spectrum SPnew'.

More specifically, the envelope adjustment section 412 adjusts the spectral intensity of the frequency spectrum SPnew' so that the spectral intensity Mnew' at the local peak P of the frequency spectrum SPnew' falls on the spectral envelope EVin. Namely, the envelope adjustment section 412 first calculates an intensity ratio $\beta$ between the spectral intensity Mnew' at one local peak P in each of the spectral distribution regions and the spectral intensity MEV of the spectral envelope EVin in the frequency Fp of the local peak P (i.e., intensity ratio $\beta$=MEV/Mnew'). Then, the envelope adjustment section 412 multiplies each of the spectral intensity Mnew', indicated by the novel spectrum data DSPnew' of the spectral distribution region, by the intensity ratio $\beta$, and sets the resultant product as intensity of the frequency spectrum SPnew'. As seen in section (e) of FIG. 4, the thus-specified spectral envelope of the frequency spectrum SPnew will agree with the spectral envelope EVin of the input voice.

Further, a reverse FFT section 15 shown in FIG. 1 generates an output voice signal Snew' of a time domain by performing a reverse FFT operation on the novel spectrum data DSPnew performed by the data generation section 3*a* per frame. Output processing section 16 multiplies the thus-generated frame-specific output voice signal Snew' by a time window function, and then generates an output voice signal Snew by connecting the resultant products of the individual frames in such a manner that they overlap with each other on the time axis. Namely, the reverse FFT section 15 and the output processing section 16 function as means for generating the output voice signal Snew from the novel spectrum data DSPnew. Voice output section 17 includes a D/A converter for converting the output voice signal Snew, supplied from the output processing section 16, into an analog electrical signal, and a sounding device (e.g., speaker or headphones) for audibly producing a voice based on the output signal from the D/A converter. The output voice generated from the voice output section 17 has characteristics of the converting hoarse voice reflected therein while maintaining the pitch and sound color of the input voice.

As having been set forth above, the instant embodiment can provide an output voice that is extremely auditorily natural, because it can specify the frequency spectrum SPnew' of the output voice on the basis of the frequency spectrum SPt of the converting voice and spectral envelope EVin of the input voice. Further, because the instant embodiment is arranged to specify any one of the plurality of templates, created from converting voices of different pitches, in accordance with the pitch Pin of the input voice, it can generate a more natural output voice than the conventional technique of generating an output voice on the basis of converting spectrum data DSPt created from a converting voice of a single pitch.

Further, the instant embodiment, where the weighting value $\alpha$ to be multiplied with the spectral intensity Mt of the frequency spectrum SPt is controlled in accordance with the gain Ain of the input voice, can generate a natural output voice closer to an actual hoarse voice than the conventional technique where the weighting value $\alpha$ is fixed. Besides, because the relationship between the gain Ain of the input voice and the weighting value $\alpha$ is adjusted in the instant embodiment in response to operation by the user, the embodiment can generate a variety of output voices suiting a user's taste.

B. Second Embodiment

Next, a description will be given about a voice processing apparatus according to a second embodiment of the present invention, with reference to FIG. 6. Note that elements of the second embodiment of the voice processing apparatus D2 similar to those in the first embodiment of the voice processing apparatus D1 are indicated by the same reference characters as in the first embodiment and description of these elements is omitted as appropriate to avoid unnecessary duplication.

Whereas the first embodiment has been described above as dividing the frequency spectrum SPin of an input voice into a plurality of spectral distribution regions Rin and also dividing the frequency spectrum SPt of a converting voice into a plurality of spectral distribution regions Rt before the frequency spectra are processed by the data generation section 3*b*, the second embodiment does not perform such diving operations. Therefore, the spectrum processing section 2*b* in the second embodiment does not include the region division section 25. Namely, once input spectrum data DSPin indicative of a frequency spectrum SPin of each frame have been supplied, for an input voice signal Sin indicated in section (a) of FIG. 7, from the frequency analysis section 12, the input spectrum data DSPin are output to the data generation section 3*b* as-is, i.e. without being divided into spectral distribution regions Rin, as seen in section (b) of FIG. 7. Envelope identification section 23 of the spectrum processing section 2*b* identifies and outputs input envelope data DEVin of the frequency spectrum SPin to the data generation section 3*b* (see section (b) of FIG. 7), as in the first embodiment.

Figure 7:
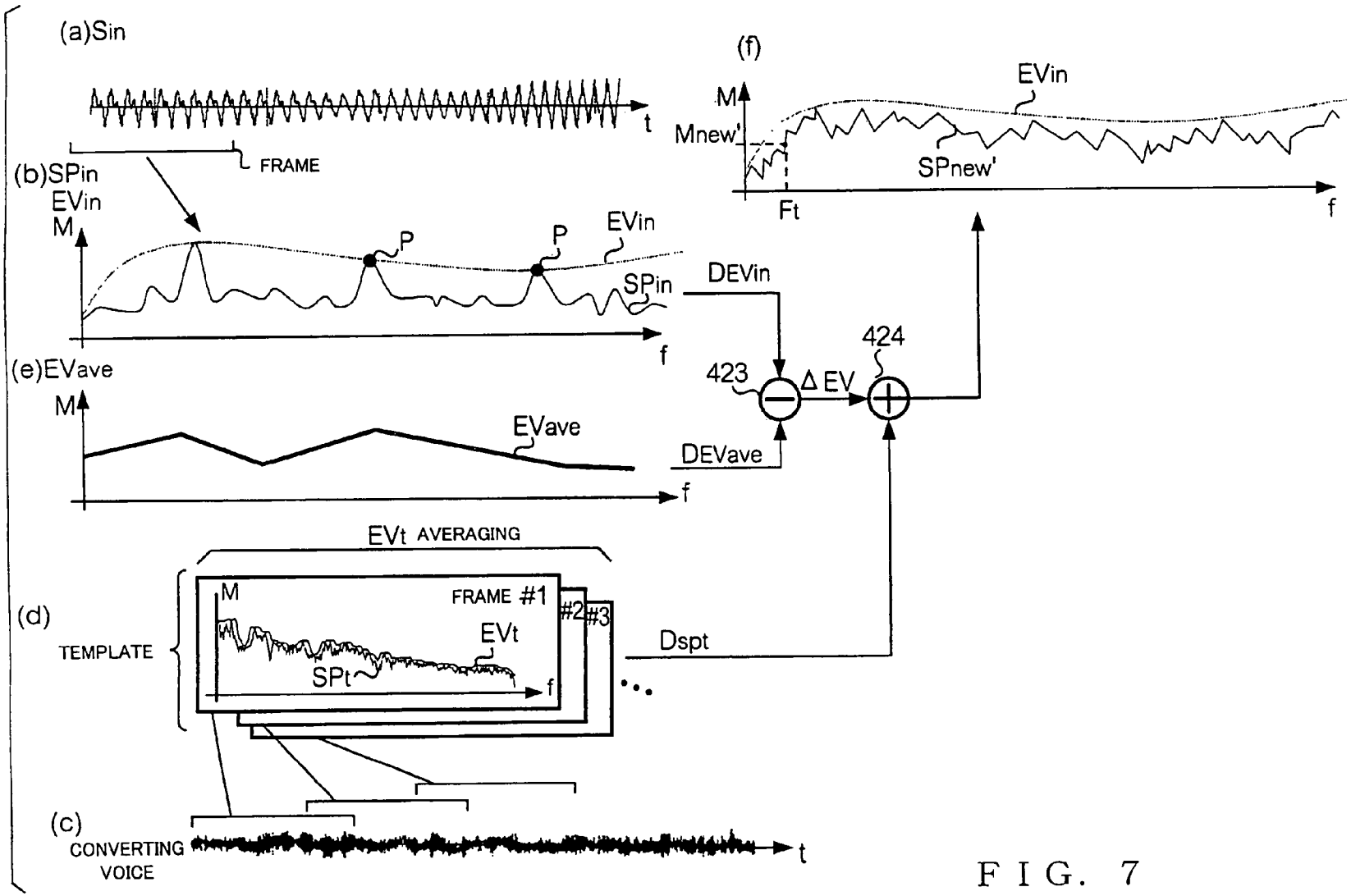
FIG. 7 is a diagram explanatory of operations performed by a data generation section in the second embodiment of the voice processing apparatus.

The second embodiment assumes that the converting voice used is an unvoiced sound (i.e., whispering voice) involving no vibration of the vocal band of the person. Even for the unvoiced sounds, differences in pitch and sound quality can be identified auditorily. So, as in the first embodiment, a plurality of templates created from converting voices of different pitches are prestored in a storage section 52 in the second embodiment. Section (c) of FIG. 7 shows a waveform of a converting voice (unvoiced sound) generated with a single pitch feeling. As in the first embodiment, the converting voice is first divided into a plurality of frames, and then a frequency spectrum SPt is identified for each of the frames, as seen in section (d) of FIG. 7. Because, as shown, the frequency spectrum SPt of the converting voice does not have characteristic frequency bands representing a fundamental sound and harmonic sounds, no local peak as shown in FIG. 3 appears in the frequency spectrum SPt. As seen in section (d) of FIG. 7, each of the templates stored in the storage sections 52 includes, for each of the frames divided from the converting voice generated with a particular pitch feeling, converting spectrum data DSPt (which, in this case, are not divided into spectral distribution envelope EVt) indicative of the frequency spectrum SPt, and converting envelope data DEVt indicative of a spectral envelope EVt of the frequency spectrum SPt.

Figure 6:
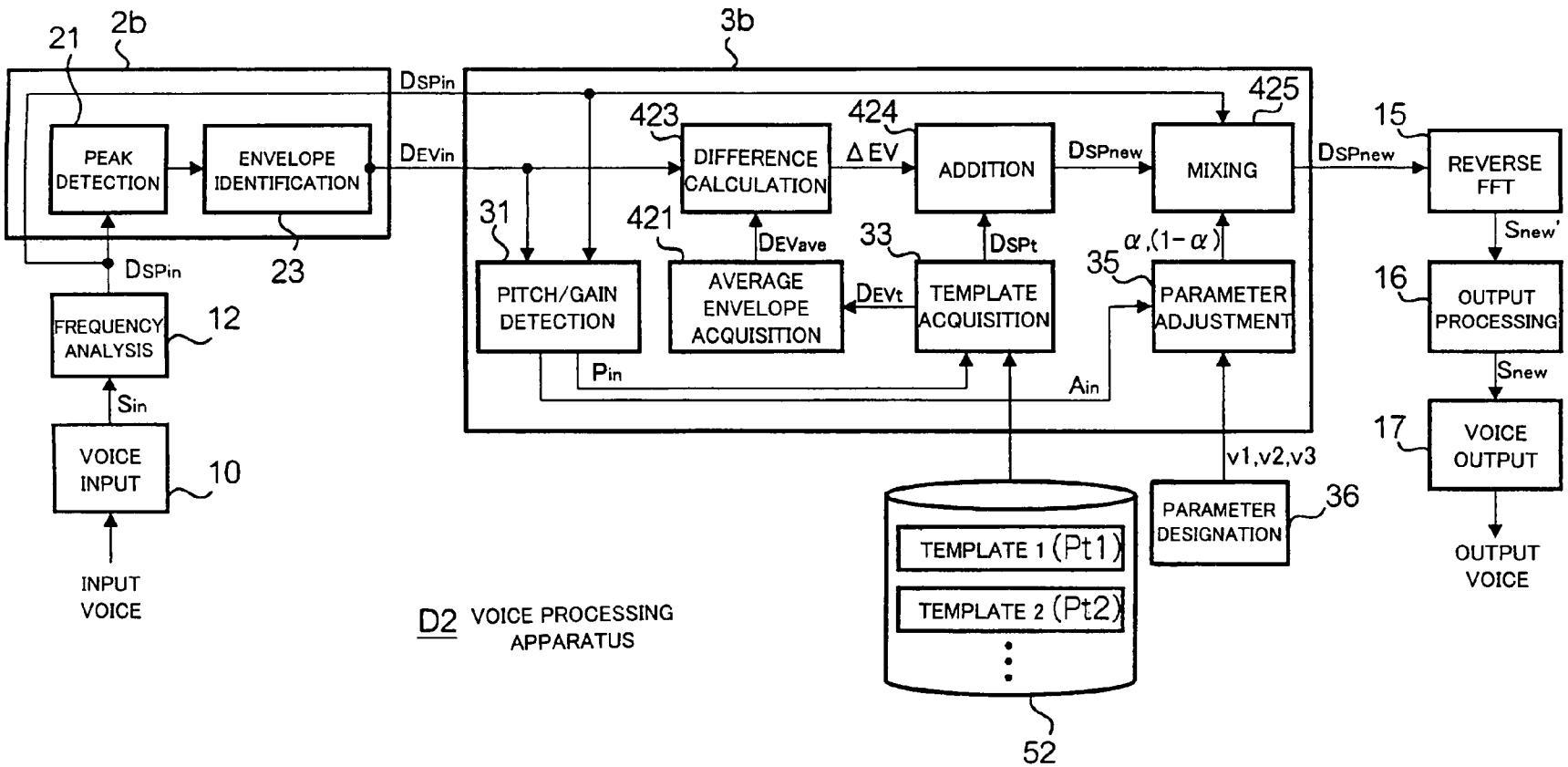
FIG. 6 is a block diagram showing a general setup of a voice processing apparatus in accordance with a second embodiment of the present invention.

As in the first embodiment, the template acquisition section 33 shown in FIG. 6 selects and reads out any one of a plurality of templates on the basis of a pitch Pin informed by the pitch/gain detection section 31. Then, the template acquisition 33 outputs the converting spectrum data DSPt of all of the frames, included in the read-out template, to an addition section 424 and the converting envelope data DEVt of all of the frames to an average envelope acquisition section 421.

The average envelope acquisition section 421 is a means for specifying a spectral envelope (i.e., "average envelope") EVave obtained by averaging the spectral envelopes EVt indicated by the converting envelope data DEVt of all of the frames, as shown in section (e) of FIG. 7. More specifically, the average envelope acquisition section 421 calculates an average value of spectral intensity of particular frequencies in the spectral envelopes EVt indicated by the converting envelope data DEVt of all of the frames and specifies an average envelope EVave having the calculated average value as its spectral intensity. Then, the average envelope acquisition section 421 outputs the average envelope data DEVave, indicative of the average envelope EVave, to a difference calculation section 423.

Input spectral envelope data EVin output from the spectrum processing section 2*b* shown in FIG. 6 are supplied to the difference calculation section 423. The difference calculation section 423 is a means for calculating a difference in spectral intensity between the average envelope EVave indicated by the average envelope data DEVave and the spectral envelope EVin indicated by the input spectral envelope data DEVin. Namely, the difference calculation section 423 calculates a difference $\Delta M$ between the spectral intensity Mt in each subject frequency Ft of the average envelope EVave and the spectral intensity Min in each subject frequency Ft of the spectral envelope EVin and outputs envelope difference data $\Delta EV$ to the addition section 424. The envelope difference data $\Delta EV$ include a plurality of unit data each comprising a set (Ft, $\Delta M$) of the subject frequency Ft and the difference $\Delta M$.

The addition section 424 is a means for adding together the frequency spectrum SPt of each of the frames, indicated by the converting spectrum data DSPt, and the difference $\Delta M$, indicated by the envelope difference data $\Delta EV$, to thereby calculate a frequency spectrum SPnew'. Namely, the addition section 424 adds together the spectral intensity Mt in each subject frequency Ft of the frequency spectrum SPt of each of the frames and the difference $\Delta M$ in the subject frequency Ft of the envelope difference data $\Delta EV$, and then specifies a frequency spectrum SPnew' having the calculated sum as the intensity Mnew'. Thus, for each of the frames, the addition section 424 outputs, new spectrum data DSPnew', indicative of the frequency spectrum SPnew', to a mixing section 425. The frequency spectrum SPnew' specified in the above-described manner has a shape reflecting therein the frequency spectrum SPt of the converting voice, as illustrated in section (f) of FIG. 7, so that a voice represented by the frequency spectrum SPnew' is an unvoiced sound similar to the converting voice. Further, because a spectral envelope represented by the frequency spectrum SPnew' generally agrees with the spectral envelope EVin of the input voice, the voice represented by the frequency spectrum SPnew' is an unvoiced sound reflecting therein phonological characteristics of the input voice. Further, because the addition section 424 adds the converting spectrum data DSPt and the envelope difference data ΔEV for each of the frames, a voice obtained by connecting together unit voices indicated by the frequency spectra SPnew' of the individual frames precisely reflects therein variation over time of the frequency spectra SPt of the individual frames of the converting voice (more specifically, fine variation in the spectral intensity Mt in the individual subject frequencies Ft).

The mixing section 425 shown in FIG. 6 is a means for mixing together the frequency spectrum SPin of the input voice and the frequency spectrum SPnew', specified by the addition section 424, at a particular ratio, to thereby specify a frequency spectrum SPnew. Namely, the mixing section 425 multiplies the spectral intensity Min in the subject frequency Fin of the frequency spectrum SPin, represented by the input spectrum data DSPin, by a weighting value $(1-\alpha)$ and also multiplies the spectral intensity Mnew in the subject frequency Ft, corresponding to (matching or approximate to) the subject frequency Fin, of the frequency spectrum SPnew, represented by the new spectrum data DSPnew', by a weighting value $\alpha$. In this way, the mixing section 425 specifies the frequency spectrum SPnew having a sum of the resultant products as spectral intensity Mnew $(=(1-\alpha)\cdot Min+\alpha\cdot Mnew')$. Then, the mixing section 425 outputs the new spectrum data DSPnew, indicative of the frequency spectrum SPnew, to the reverse FFT section 15. Operations following the output of the new spectrum data DSPnew are similar to those in the first embodiment.

Figure 8:
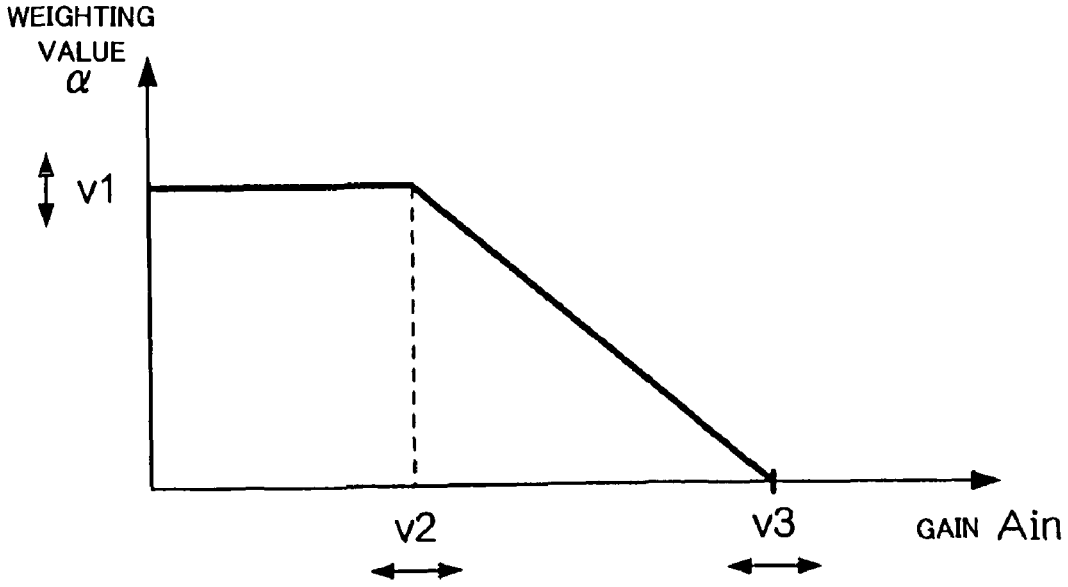
FIG. 8 is a graph plotting relationship between a gain of an input voice and a weighting value in the second embodiment.

As in the first embodiment, the weighting value a to be used in the mixing section 425 is selected by the parameter adjustment section 35 in accordance with the gain Ain of the input voice and parameters entered by the user via the parameter designation section 36. However, because the converting voice is an unvoiced sound in the second embodiment, the relationship between the gain Ain of the input voice and the weighting value $\alpha$ differs from that in the first embodiment. Generally, there is a tendency that degree of breathiness in a voice becomes more auditorily prominent (namely, the voice sounds more like a whispering voice) as the volume of the voice decreases. In order to reproduce such a tendency, appropriate relationship between the gain Ain of the input voice and the weighting value $\alpha$ is set in the instant embodiment such that the weighting value a increases as the gain Ain of the input voice becomes smaller, as seen in FIG. 8. Parameters v1, v2 and v3 shown in FIG. 8 are set in response to user's operation on the parameter designation section 36. The parameter v1 represents a value of the weighting value $\alpha$ when the gain Ain of the input voice is of a minimum value (i.e., maximum value of the weighting value $\alpha$), the parameter v2 represents a maximum value of the gain Ain when the weighting value $\alpha$ takes the maximum value v1, and the parameter v3 represents a value of the gain Ain when the weighting value $\alpha$ takes the minimum value (zero).

As having been set forth above, the instant embodiment, similarly to the first embodiment, can provide an output voice that is extremely auditorily natural, because it can specify the frequency spectrum SPnew' of the output voice on the basis of the frequency spectrum SPt of the converting voice and spectral envelope EVin of the input voice. Further, because the instant embodiment is arranged to generate the frequency spectrum SPnew of the output voice by mixing together the frequency spectrum SPnew' of the aspirate (unvoiced) sound and frequency spectrum SPin of the input voice (typically a voiced sound) at a ratio corresponding to the gain Ain of the input voice, it can generate a natural output voice close to actual behavior of the vocal band of a person.

C. Third Embodiment

Next, a description will be given about a voice processing apparatus according to a third embodiment of the present invention, with reference to FIG. 9. The third embodiment of the voice processing apparatus D3 is constructed substantially as a combination between the first embodiment of the voice processing apparatus D1 and the second embodiment D2 of the voice processing apparatus. Note that elements of the third embodiment of the voice processing apparatus D3 similar to those in the first and second embodiments are indicated by the same reference characters as in the first and second embodiments and description of these elements is omitted to avoid unnecessary duplication.

Figure 9:
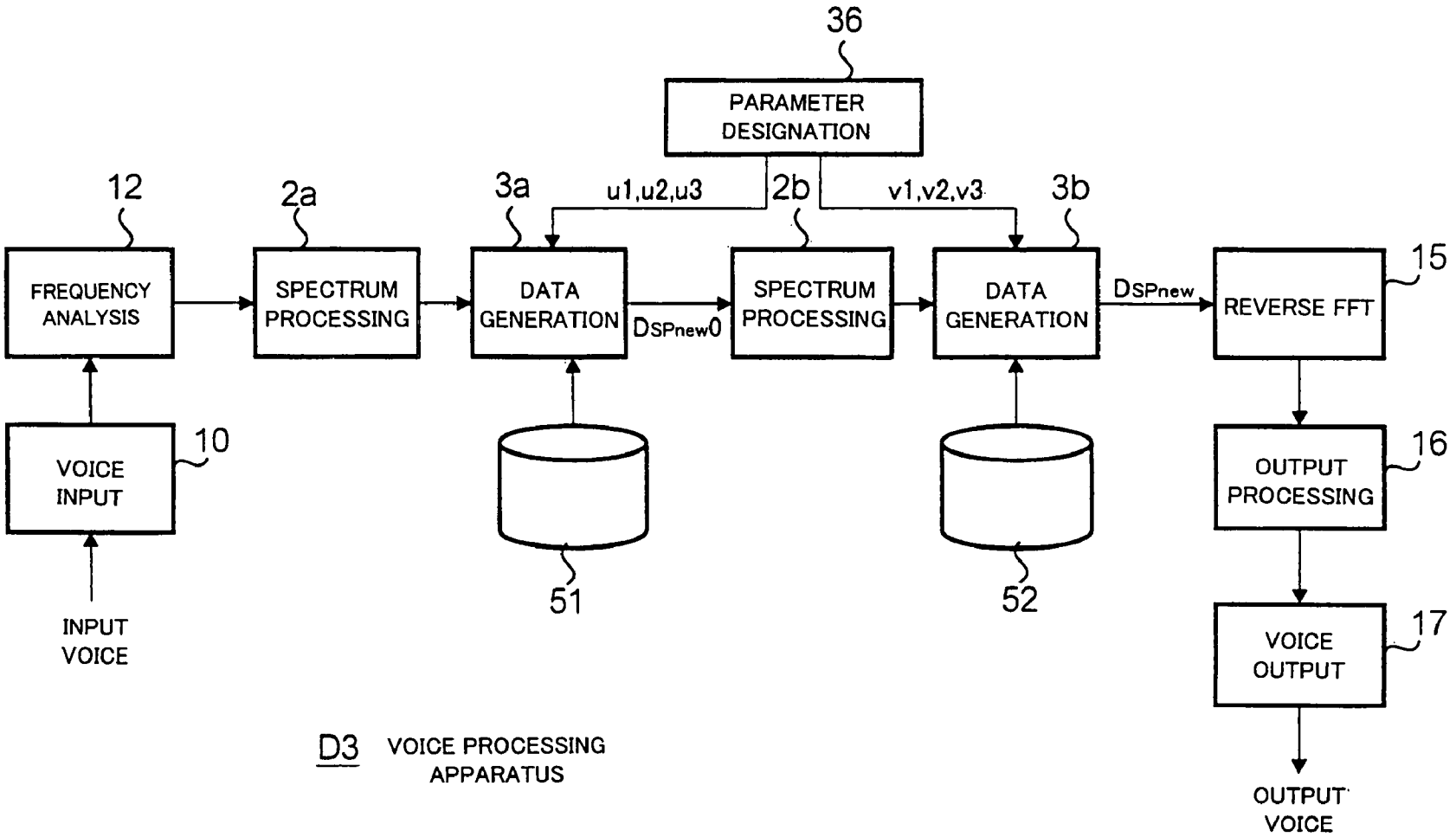
FIG. 9 is a block diagram showing a general setup of a voice processing apparatus in accordance with a third embodiment of the present invention.

As illustrated in FIG. 9, the voice processing apparatus D3 is characterized primarily in that a spectrum processing section 2*a* and data generation section 3*a* similar to those shown in the first embodiment are disposed at a stage following the voice input section 10 and frequency analysis section 12, and that a spectrum processing section 2*b* and data generation section 3*b* similar to those shown in the second embodiment are disposed at a stage following the data generation section 3*a*. New spectrum data DSPnew output from the data generation section 3*b* are output to the reverse FFT section 15. The parameter designation section 36 functions both as a means for designating the parameters u1, u2 and u3 to the data generation section 3*a* and as a means for designating the parameters v1, v2 and v3 to the data generation section 3*b*.

In the third embodiment thus arranged, the spectrum processing section 2*a* and data generation section 3*a* output new spectrum data DSPnew0 on the basis of input spectrum data DSPin supplied from the frequency analysis section 12 and a template of a converting voice stored in the storage section 51, in generally the same manner described above in relation to the first embodiment. Further, the spectrum processing section 2*b* and data generation section 3*b* output new spectrum data DSPnew on the basis of the new spectrum data DSPnew0 supplied from the data generation section 3*a* and a template of a converting voice stored in the storage section 52, in generally the same manner described above in relation to the second embodiment. The thus-arranged third embodiment can achieve generally the same benefits as the other embodiments.

Whereas the storage sections 51 and 52 are shown in FIG. 9 as separate components, they may be replaced with a single storage section where templates similar to those employed in the first and second embodiments are stored collectively. Further, the spectrum processing section 2*b* and data generation section 3*b* similar to those in the second embodiment may be provided at a stage preceding the spectrum processing section 2*a* and data generation section 3*a* similar to those in the first embodiment.

D. Modification

The above-described embodiments may be modified variously, as explained by way of example below. The modifications explained below may also be used in combination as appropriate.

(1) Whereas the first embodiment has been described above specifying the frequency spectrum SPnew' by adding together the spectral intensity Min of the frequency spectrum SPin and the spectral intensity Mt of the frequency spectrum SPt, the frequency spectrum SPnew' may be specified in any other suitable manner. For example, the frequency spectrum SPnew' may be generated by replacing the frequency spectrum SPin, shown in section (c) of FIG. 4, with the frequency spectrum SPt shown in section (b) of FIG. 4. Also, whereas the first embodiment has been described above specifying the frequency spectrum SPnew by multiplying the frequency spectrum SPnew' by the intensity ratio β between the spectral intensity Mnew' of the frequency spectrum SPnew' and the spectral intensity MEV of the spectral envelope EVin of the input voice, the frequency spectrum SPnew' may be specified in any other suitable manner. For example, the frequency spectrum SPnew' may be generated by adding a particular numerical value to the spectral intensity Mnew' of the frequency spectrum SPnew', shown in section (d) of FIG. 4, per spectral distribution region Rin (i.e., by translating the frequency spectrum SPnew' along the vertical axis shown in section (d) of FIG. 4). The numerical value to be added here is, for example, a difference between the spectral intensity MEV of the spectral envelope EVin and the spectral intensity Mnew' of the frequency spectrum SPnew'. Namely, with the first embodiment, it is only necessary that the shape of the frequency spectrum SPt of the converting voice be reflected in the frequency spectrum SPnew' (and in the frequency spectrum SPnew of the output voice), and the frequency spectrum SPnew' may be specified in any desired manner.

Figure 10:
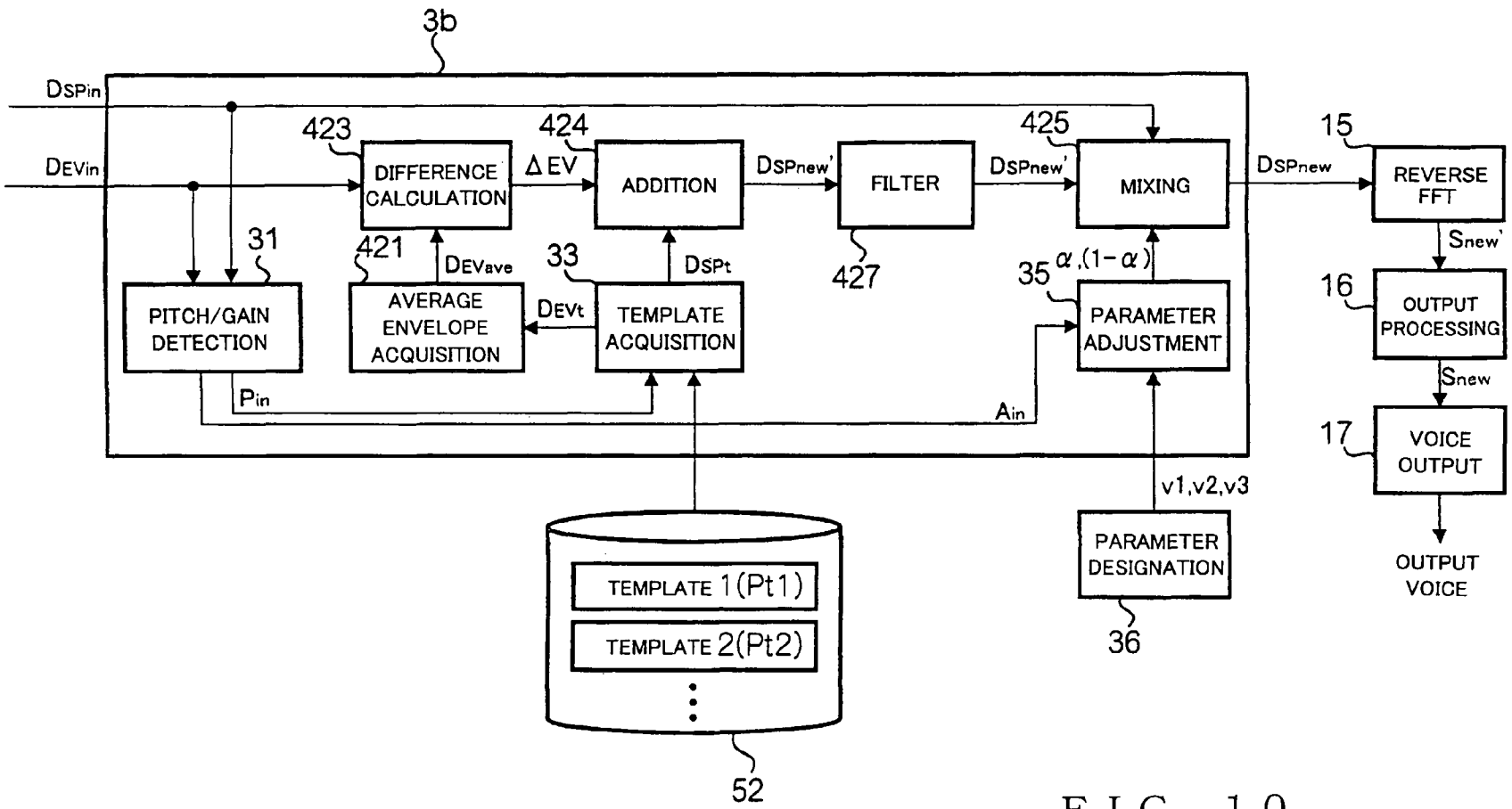
FIG. 10 is a block diagram showing a general setup of a modification of the second embodiment of the present invention.

(2) In the above-described second embodiment, the frequency spectrum SPnew' of the aspirate sound is distributed over wide frequency bands. However, considering the tendency that aspirate sounds are higher in frequency than voiced sounds (namely, low-frequency voices can hardly become whispering voices), it is desirable to remove components of particularly low frequencies from the frequency spectrum SPnew', in order to generate a more natural output voice. For this purpose, a filter 427 may be provided at a stage following the addition section 424 specifying the frequency spectrum SPnew', as seen in FIG. 10. The filter 427 is a high-pass filter that selectively passes only components of frequencies higher than a predetermined cutoff frequency. Because, in such a case, components lower than the cutoff frequency can be removed from the aspirate sound, it is possible to generate a more natural output voice closer to an actual voice. Further, there may be employed arrangements for raising or lowering the cutoff frequency, for example, in response to operation by the user, or in accordance with the pitch Pin and/or gain Ain detected by the pitch/gain detection section 31.

Figure 11:
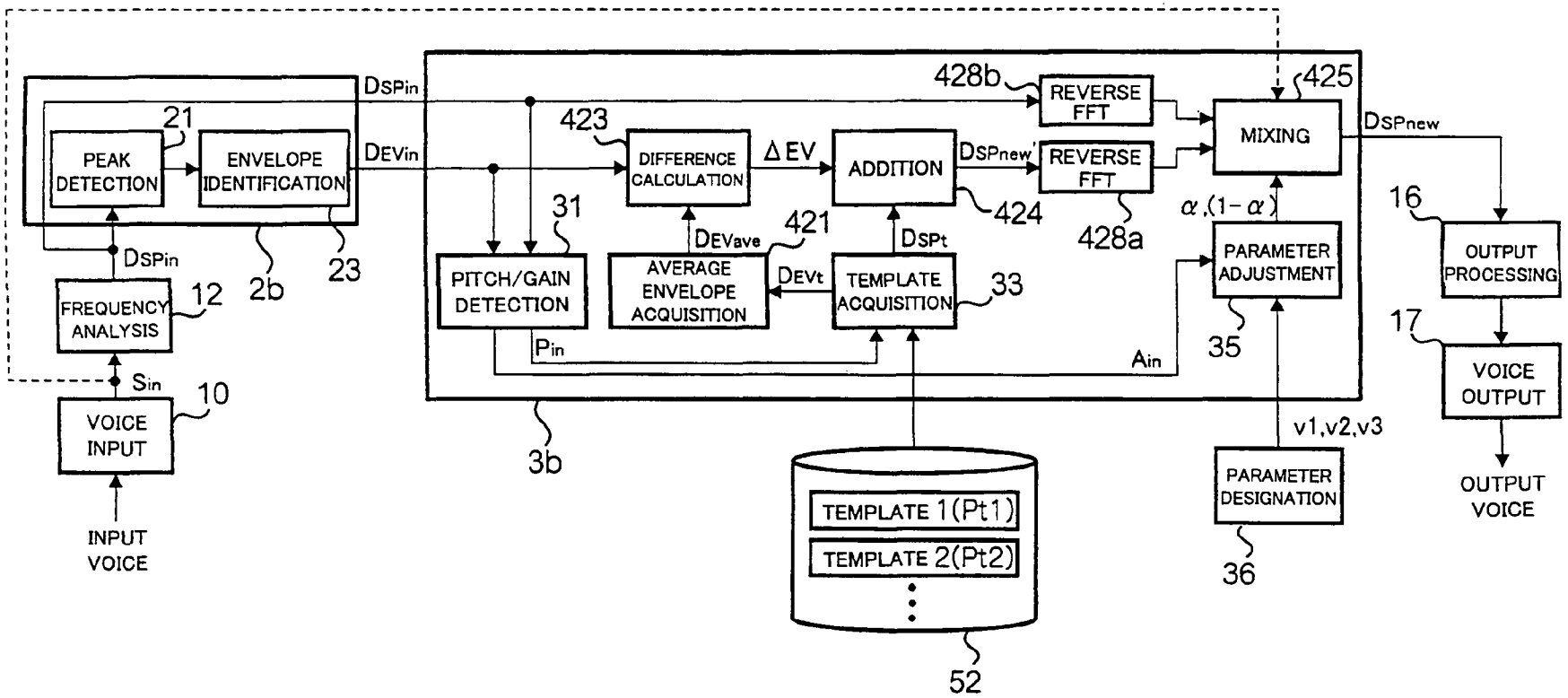
FIG. 11 is a block diagram showing a general setup of another modification of the second embodiment of the present invention.

(3) Further, the second embodiment has been described above as performing the reverse FFT process on the frequency spectrum SPnew' representative of an aspirate sound and the frequency spectrum SPin of an input voice after mixing these frequency spectra SPnew' and SPin. In an alternative, as illustrated in FIG. 11, the mixing section 425 may mix together a signal (i.e., time-domain signal representative of an aspirate sound) generated by subjecting the frequency spectrum SPnew' to the reverse FFT process by a reverse FFT section 428*a* provided at a stage following the addition section 424, and a signal (i.e., a time-domain signal representative of an input voice) generated by subjecting the frequency spectrum SPin to the reverse FFT process by a reverse FFT section 428*b*. In this case too, arrangements may be employed such that the mixing ratio (weighting value α) in the mixing section 425 is adjusted as appropriate by the parameter adjustment section 35. Whereas the modification has been described above as supplying the mixing section 425 with the output signal from the reverse FFT section 428*b*, the input voice signal Sin output from the voice input section 10 may be supplied directly to the mixing section 425 for mixing with the output signal from the reverse FFT section 428*a*, as indicated by a dotted line in FIG. 11.

(4) Further, in the above-described second embodiment, the average envelope acquisition section 421 specifies the average envelope EVave from the converting envelope data DEVt of a plurality of frames. Alternatively, average envelope data DEVave indicative of the average envelope EVave may be prestored in the storage section 52; in this case, the average envelope acquisition section 421 reads out the average envelope data DEVave from the storage section 52 and supplies the read-out envelope data DEVave to the difference calculation section 423. Further, whereas the embodiment has been described as specifying the average envelope EVave from the converting envelope data DEVt of the individual frames, the average envelope EVave may be specified by averaging the converting spectrum data DSPt indicative of the frequency spectra SPt of the individual frames.

(5) Furthermore, whereas the embodiments have been described as using a hoarse voice or whispering voice as the converting voice, the form (especially, waveform) of the converting voice may be chosen as desired. For example, a voice of a sinusoidal waveform may be used as the converting voice. In this case, once a hoarse voice or whispering voice is input as an input voice, the modification can generate a clear output voice having removed therefrom roughness caused by irregular vibration of the vocal band or breathiness caused by aspiration by a person having uttered the voice.

Finally, it should be appreciated that the present invention is applicable to processing of not only human voices but also other types of voices or sounds.

What is claimed is:

1. A voice processing apparatus comprising:

a frequency analysis section that identifies a first frequency spectrum of an input voice comprising complex frequency components and having a plurality of local intensity peaks, wherein said frequency analysis section generates, for each first spectral distribution region that contains a frequency presenting one of said local intensity peaks in the first frequency spectrum of the input voice, input spectrum data indicative of a frequency spectrum belonging to the first spectral distribution region;

an envelope identification section that generates input envelope data indicative of a spectral envelope of the first frequency spectrum identified by said frequency analysis section;

an acquisition section that acquires converting spectrum data indicative of a second frequency spectrum of a converting voice comprising complex frequency components and having a plurality of local intensity peaks, wherein said acquisition section acquires, for each second spectral distribution region that contains a frequency presenting one of said local intensity peaks in the second frequency spectrum of the converting voice, converting spectrum data indicative of a frequency spectrum belonging to the second spectral distribution region;

a data generation section that, on the basis of the input envelope data generated by said envelope identification section and the converting spectrum data generated by said acquisition section, generates new spectrum data indicative of a frequency spectrum corresponding in shape to the second frequency spectrum of the converting voice and having a substantially same spectral envelope as the spectral envelope of the input voice; and a signal generation section that generates a voice signal on the basis of the new spectrum data generated by said data generation section, wherein said data generation section includes:

a spectrum conversion section that associates the first spectral distribution regions and the second spectral distribution regions in order of frequencies, repositions, independently for each of the second spectral distribution regions, the frequency spectrum of the converting spectrum data of each of the second spectral distribution regions on the frequency axis in such a manner that the frequency of the local intensity peak belonging to the second spectral distribution region substantially matches the frequency of the local intensity peak belonging to the first spectral distribution region associated with the second spectral distribution region, and generates converted spectrum data on the basis of the repositioned frequency spectrum of the converting spectrum data;

and an envelope adjustment section that adjusts intensity of a frequency spectrum of the converted spectrum data on the basis of the input envelope data to generate the new spectrum data, and wherein said spectrum conversion section further adds together, for each of the first spectral distribution regions of the input voice and at a particular ratio, intensity indicated by the input spectrum data of the first spectral distribution region and intensity indicated by the repositioned frequency spectrum of the converting spectrum data of the second spectral distribution region associated with the first spectral distribution region, to thereby generate the converted spectrum data indicative of a frequency spectrum having as intensity thereof a sum of the intensity.

2. A voice processing apparatus as claimed in claim 1 which further comprises:

a sound volume detection section that detects a sound volume of the input voice; and a parameter adjustment section that varies the particular ratio in accordance with the sound volume detected by said sound volume detection section.

3. A voice processing apparatus as claimed in claim 1 which further comprises:

a storage section that stores a plurality of converting spectrum data indicative of frequency spectra of converting voices different in pitch; and a pitch detection section that detects a pitch of the input voice, and wherein said acquisition section acquires, from among the plurality of converting spectrum data stored in said storage section, converting spectrum data corresponding to the pitch detected by said pitch detection section.

4. A voice processing apparatus comprising:

a frequency analysis section that identifies a first frequency spectrum of an input voice comprising complex frequency components and having a plurality of local intensity peaks, wherein said frequency analysis section generates, for each first spectral distribution region that contains a frequency presenting one of said local intensity peaks in the first frequency spectrum of the input voice, input spectrum data indicative of a frequency spectrum belonging to the first spectral distribution region;

an envelope identification section that generates input envelope data indicative of a spectral envelope of the first frequency spectrum identified by said frequency analysis section;

an acquisition section that acquires converting spectrum data indicative of a second frequency spectrum of converting voice comprising complex frequency components and having a plurality of local intensity peaks, wherein said acquisition section acquires, for each second spectral distribution region that contains a frequency presenting one of said local intensity peaks in the second frequency spectrum of the converting voice, converting spectrum data indicative of a frequency spectrum belonging to the second spectral distribution region;

a data generation section that, on the basis of the input envelope data generated by said envelope identification section and the converting spectrum data generated by said acquisition section, generates new spectrum data indicative of a frequency spectrum corresponding in shape to the second frequency spectrum of the converting voice and having a substantially same spectral envelope as the spectral envelope of the input voice; and a signal generation section that generates a voice signal on the basis of the new spectrum data generated by said data generation section, wherein said data generation section includes:

a spectrum conversion section that associates the first spectral distribution regions and the second spectral distribution regions in order of frequencies, repositions, independently for each of the second spectral distribution regions, the frequency spectrum of the converting spectrum data of each of the second spectral distribution regions on the frequency axis in such a manner that the frequency of the local intensity peak belonging to the second spectral distribution region substantially matches the frequency of the local intensity peak belonging to the first spectral distribution region associated with the second spectral distribution region, and generates converted spectrum data on the basis of the repositioned frequency spectrum of the converting spectrum data; and an envelope adjustment section that adjusts intensity of a frequency spectrum of the converted spectrum data on the basis of the input envelope data to generate the new spectrum data, and wherein said spectrum conversion section generates the converted spectrum data by replacing the input spectrum data of each of the first spectral distribution regions with the repositioned frequency spectrum of the converting spectrum data corresponding to the second spectral distribution region associated with each of the first spectral distribution regions.

5. A voice processing apparatus comprising:

a frequency analysis section that identifies a first frequency spectrum of an input voice;

an envelope identification section that generates input envelope data indicative of a spectral envelope of the first frequency spectrum identified by said frequency analysis section;

an acquisition section that acquires converting spectrum data indicative of a second frequency spectrum of a converting voice;

a data generation section that, on the basis of the input envelope data generated by said envelope identification section and the converting spectrum data generated by said acquisition section, generates new spectrum data indicative of a frequency spectrum corresponding in shape to the second frequency spectrum of the converting voice and having a substantially same spectral envelope as the spectral envelope of the input voice;

a signal generation section that generates a voice signal on the basis of the new spectrum data generated by said data generation section;

a storage section that stores converting spectrum data for each of a plurality of frames obtained by dividing a converting voice on a time axis; and an average envelope acquisition section that acquires average envelope data indicative of an average envelope obtained by averaging intensity of spectral envelopes in the frames of the converting voice, and wherein said data generation section includes: a difference calculation section that calculates a difference between intensity of the spectral envelope indicated by the input envelope data and intensity of the average envelope indicated by the average envelope data; and an addition section that adds intensity of the second frequency spectrum indicated by the converting spectrum data for each of the frames and the difference calculated by said difference calculation section, said data generation section generating the new spectrum data on the basis of a value calculated by said addition section.

6. A voice processing apparatus as claimed in claim 5 which further comprises a filter section that selectively passes therethrough a component of a voice, indicated by the new spectrum data, that belongs to a frequency band exceeding a cutoff frequency.

7. A voice processing apparatus as claimed in claim 6 which further comprises a sound volume detection section that detects a sound volume of the input voice, and wherein said filter varies the cutoff frequency in accordance with the sound volume detected by said sound volume detection section.

8. A voice processing apparatus as claimed in claim 5 wherein said data generation section adds together, at a particular ratio, intensity of the frequency spectrum having as intensity thereof a value calculated by said addition section and intensity of the first frequency spectrum detected by said frequency analysis section, to thereby generate the new spectrum data indicative of the frequency spectrum having as intensity thereof a sum of the intensity calculated by said data generation section.

9. A voice processing apparatus as claimed in claim 8 which further comprises:

a sound volume detection section that detects a sound volume of the input voice; and a parameter adjustment section that varies the particular ratio in accordance with the sound volume detected by said sound volume detection section.

10. A computer readable storage medium containing a program for causing a computer to perform:

a frequency analysis process for identifying a first frequency spectrum of an input voice comprising complex frequency components and having a plurality of local intensity peaks, wherein said frequency analysis section generates, for each first spectral distribution region that contains a frequency presenting one of said local intensity peaks in the first frequency spectrum of the input voice, input spectrum data indicative of a frequency spectrum belonging to the first spectral distribution region;

an envelope identification process for generating input envelope data indicative of a spectral envelope of the first frequency spectrum identified by said frequency analysis process;

an acquisition process for acquiring converting spectrum data indicative of a second frequency spectrum of a converting voice comprising complex frequency components and having a plurality of local intensity peaks, wherein said acquisition section acquires, for each second spectral distribution region that contains a frequency presenting one of said local intensity peaks in the second frequency spectrum of the converting voice, converting spectrum data indicative of a frequency spectrum belonging to the second spectral distribution;

a data generation process for, on the basis of the input envelope data generated by said envelope identification process and the converting spectrum data acquired by said acquisition process, generating new spectrum data indicative of a frequency spectrum corresponding in shape to the second frequency spectrum of the converting voice and having a substantially same spectral envelope as the spectral envelope of the input voice; and a signal generation process for generating a voice signal on the basis of the new spectrum data generated by said data generation process, wherein said data generation process includes:

a spectrum conversion process for associating the first spectral distribution regions and the second spectral distribution regions in order of frequencies, repositioning, independently for each of the second spectral distribution regions, the frequency spectrum of the converting spectrum data of each of the second spectral distribution regions on the frequency axis in such a manner that the frequency of the local intensity peak belonging to the second spectral distribution region substantially matches the frequency of the local intensity peak belonging to the first spectral distribution region associated with the second spectral distribution region and generating converted spectrum data on the basis of the repositioned frequency spectrum of the converting spectrum data; and an envelope adjustment process for adjusting intensity of a frequency spectrum of the converted spectrum data on the basis of the input envelope data to generate the new spectrum data, and wherein said spectrum conversion process further adds together, for each of the first spectral distribution regions of the input voice and at a particular ratio, intensity indicated by the input spectrum data of the first spectral distribution region and intensity indicated by the repositioned frequency spectrum of the converting spectrum data of the second spectral distribution region associated with the first spectral distribution region, to thereby generate the converted spectrum data indicative of a frequency spectrum having as intensity thereof a sum of the intensity.

11. A computer readable storage medium containing a program for causing a computer to perform:

a frequency analysis process for identifying a first frequency spectrum of an input voice;

an envelope identification process for generating input envelope data indicative of a spectral envelope of the first frequency spectrum identified by said frequency analysis process;

an acquisition process for acquiring converting spectrum data indicative of a second frequency spectrum of a converting voice;

a data generation process for, on the basis of the input envelope data generated by said envelope identification process and the converting spectrum data acquired by said acquisition process, generating new spectrum data indicative of a frequency spectrum corresponding in shape to the second frequency spectrum of the converting voice and having a substantially same spectral envelope as the spectral envelope of the input voice;

a signal generation process for generating a voice signal on the basis of the new spectrum data generated by said generation process; and an average envelope acquisition process for acquiring average envelope data indicative of an average envelope obtained by averaging spectral envelopes of a plurality of frames of a converting voice, the frames being obtained by dividing the converting voice on a time axis, and wherein said data generation process includes: a difference calculation operation for calculating a difference between intensity of the spectral envelope indicated by the input envelope data and intensity of the average envelope indicated by the average envelope data; and an addition operation for adding together intensity of the frequency spectrum indicated by the converting spectrum data for each of the frames and the difference calculated by said difference calculation operation, said data generation process generating the new spectrum data on the basis of a result of addition by said addition process.

* * * * *